US008577562B2

(12) United States Patent
Tochizawa et al.

(10) Patent No.: US 8,577,562 B2
(45) Date of Patent: Nov. 5, 2013

(54) CONSTRUCTION VEHICLE

(75) Inventors: Mamoru Tochizawa, Hiratsuka (JP); Koji Takahashi, Hiratsuka (JP); Yoshiaki Saito, Kawaguchi (JP)

(73) Assignee: Komatsu Ltd., Tokyo (JP)

( * ) Notice: Subject to any disclaimer, the term of this patent is extended or adjusted under 35 U.S.C. 154(b) by 160 days.

(21) Appl. No.: 13/257,207

(22) PCT Filed: Mar. 15, 2010

(86) PCT No.: PCT/JP2010/054355
§ 371 (c)(1),
(2), (4) Date: Sep. 16, 2011

(87) PCT Pub. No.: WO2010/107000
PCT Pub. Date: Sep. 23, 2010

(65) Prior Publication Data

US 2012/0003070 A1 Jan. 5, 2012

(30) Foreign Application Priority Data

Mar. 18, 2009 (JP) ..... 2009-065903

(51) Int. Cl.
*G06F 19/00* (2011.01)

(52) U.S. Cl.
USPC ..... 701/50; 701/2; 701/54; 701/67; 701/89

(58) Field of Classification Search
USPC ..... 701/2, 50, 54, 67, 89
See application file for complete search history.

(56) References Cited

U.S. PATENT DOCUMENTS 5,265,705 A * 11/1993 Takasugi et al. ..... 192/3.55
6,002,979 A * 12/1999 Ishizu ..... 701/86
6,330,909 B1 * 12/2001 Takahashi et al. ..... 165/202
6,405,844 B1 6/2002 Takamatsu
6,564,548 B2 * 5/2003 Nishimura et al. ..... 60/431
7,610,136 B2 * 10/2009 Okamura et al. ..... 701/50
7,730,648 B2 * 6/2010 Fukaya ..... 37/443
8,036,797 B2 * 10/2011 Johnson et al. ..... 701/50

(Continued)

FOREIGN PATENT DOCUMENTS

JP 4331827 A 11/1992
JP 6220892 A 8/1994

(Continued)

OTHER PUBLICATIONS

The International Search Report mailed on Jun. 15, 2010 for the corresponding International Patent Application No. PCT/JP2010/054355 (and English translation).

*Primary Examiner* — James Trammell
*Assistant Examiner* — Truc M Do
(74) *Attorney, Agent, or Firm* — Posz Law Group, PLC

(57) ABSTRACT

The construction vehicle is provided with an engine, a clutch, a travel device, a work equipment, a drive force setting dial, and a controller that includes: a theoretical value determination unit that determines a theoretical value, for the degree of engagement to make the upper limit value of the drive force equal to a set drive force; an operational state determination unit that determines whether the work equipment is outputting the drive force in a predetermined travel direction; a drive force determination unit that determines whether the drive force is greater than the set drive force; and a degree of engagement reduction unit that, if of operational state determination and of drive force determination are both affirmative, causes the degree of engagement to approach the theoretical value.

17 Claims, 8 Drawing Sheets

(56) References Cited

U.S. PATENT DOCUMENTS

| | | | | |
|---|---|---|---|---|
| 2002/0073699 | A1* | 6/2002 | Nishimura et al. | 60/325 |
| 2005/0177292 | A1* | 8/2005 | Okamura et al. | 701/50 |
| 2006/0179690 | A1* | 8/2006 | Ikari | 37/348 |
| 2008/0234901 | A1* | 9/2008 | Johnson et al. | 701/50 |
| 2008/0234902 | A1* | 9/2008 | Johnson et al. | 701/50 |
| 2008/0275596 | A1* | 11/2008 | Tarasinski et al. | 701/1 |
| 2009/0282709 | A1* | 11/2009 | Fukaya | 37/403 |
| 2011/0308879 | A1* | 12/2011 | Shirao et al. | 180/306 |
| 2012/0330515 | A1* | 12/2012 | Numazaki et al. | 701/50 |

FOREIGN PATENT DOCUMENTS

| | | | |
|---|---|---|---|
| JP | 8290891 | A | 11/1996 |
| JP | 2001-146928 | A | 5/2001 |
| JP | 2002-36867 | A | 2/2002 |
| JP | 2005-146886 | A | 6/2005 |

* cited by examiner

FIG. 7

| DRIVE FORCE DEVIATION [kgf] | BUILD-DOWN VALUE [kg/cm2] |
|---|---|
| 0 | 0.00 |
| 800 | 0.00 |
| 1000 | 0.01 |
| 2000 | 0.02 |
| 3000 | 0.03 |

FIG. 8

| DRIVE FORCE DEVIATION [kgf] | BUILD-UP VALUE [kg/cm2] |
|---|---|
| 0 | 0.00 |
| 800 | 0.00 |
| 1000 | 0.01 |
| 2000 | 0.02 |
| 3000 | 0.03 |

CONSTRUCTION VEHICLE

CROSS REFERENCE TO RELATED APPLICATIONS

This application is a U.S. national stage application of PCT/JP2010/054355 filed on Mar. 15, 2010, and claims priority to, and incorporates by reference, Japanese Patent Application No. 2009-065903 filed on Mar. 18, 2009.

TECHNICAL FIELD

The present invention relates to a construction vehicle, and in particular relates to a technique for control of the travel drive force.

BACKGROUND ART

With a construction vehicle such as, for example, a wheel loader or the like, when performing a task such as excavation that requires a large travel drive force, if the travel drive force being outputted from the travel drive wheels (i.e. the travel propulsion force) is excessively great in view of the state of the road surface, slippage between the tires and the road surface, destruction of a fragile road surface, or the like may occur, and this leads to a decrease in the efficiency of working. Moreover, tire slippage is accompanied by early wear and tear upon the tires, and this leads to the tire exchange frequency becoming high and to increase of the cost of vehicle maintenance.

If, in order to solve this problem, the driver observes the state of the road surface and sets the travel drive force by a manual setting procedure such as by operating a dial or the like, then, when the travel drive force that is actually being outputted during excavation (i.e. the actual drive force) exceeds this set drive force, a technique may be implemented by the wheel loader or the like for steadily reducing the actual drive force according to a decrease value that corresponds to this deviation between the actual drive force and the set drive force.

Moreover, techniques are also known for presenting slippage by detecting a symptom of slippage of the travel drive wheels and by adjusting the degree of engagement of a modulation clutch, or by adjusting the fuel injection amount for the engine (for example, refer to Patent Documents #1 and #2).

PRIOR ART DOCUMENTS

Patent Documents

Patent Document #1: Japanese Laid-Open Patent Publication 2001-146928;

Patent Document #2: Japanese Laid-Open Patent Publication 2005-146886.

SUMMARY OF THE INVENTION

Problems to be Solved by the Invention

In the case of such prior art control in which, as described above, the degree of engagement of the modulation clutch is steadily decreased according to a decrease value that corresponds to the deviation between the actual drive force and the set drive force, this takes a certain period of time (for example of the order of 10 seconds) corresponding to from the time point when this control starts until the actual drive force decreases to the set drive force. In particular in the case of a large sized construction vehicle, this is because the inertia of the vehicle body is great. However, since the time period required for an excavation task is normally not all that long (for example of the order of 5 seconds), accordingly it is often the case that the efficacy of this control does not become apparent during a digging task.

Accordingly, the object of the present invention is, when a construction vehicle is performing a task of a type that requires a large travel drive force such as excavation, to enhance the response speed of control for preventing this travel drive force from becoming excessively great.

Means for Solving the Problems

A construction vehicle according to one embodiment of the present invention comprises: a power source (130); a travel device (138) than comprises a modulation clutch (140) connected to said power source, and that receives power from said power source via said modulation clutch and outputs travel drive force; a work equipment (106) for performing excavation and at least one other type of task; a drive force setting device (162) that sets a set drive force; and a controller (160) that controls the degree of engagement of said modulation clutch, on the basis of said travel drive, force outputted from said travel device and said set drive force set by said drive force setting device; wherein said controller comprises: a theoretical value determination unit (167) that determines a theoretical value, which is a value that said degree of engagement must assume in order to make the upper limit value of said travel drive force be equal to said set drive force; an operational state determination unit (168) that performs operational state determination by determining whether or not said work equipment is performing a task of a predetermined type and moreover said travel device is outputting said travel drive force in a predetermined travel direction; a drive force determination unit (169) that performs drive force determination by determining whether or not said travel drive force is greater than said set drive force; and a degree of engagement reduction unit (170) that, if the result of said operational state determination and the result of said drive force determination are both affirmative, reduces said degree of engagement so that said degree of engagement approaches towards said theoretical value. Here, while the numerals in the parentheses in the above description and the subsequent explanation are the reference numerals of corresponding elements in the preferred embodiment that will be described hereinafter, these are given by way of example for explanation; the scope of the present invention is not to be considered as being limited thereby.

With the prior art control described above, one of the reasons that too long a time period is taken for the actual drive force to drop down to the set drive force is considered to be the aspect that, along with the deviation between the actual drive force and the set drive force becoming smaller, the value by which the degree of engagement of the modulation clutch also decreases. Due to this, while it is possible to prevent control undershoot (the problem of the actual drive force due to this control decreasing too much), there is the problem of the response speed of the type of control described above being bad. By contrast, with a construction vehicle according to the above described embodiment of the present invention, a theoretical value is determined, which is the value that the degree of engagement of the modulation clutch should assume in order for the upper limit value of the actual drive force to be made equal to the set drive force, and, when a necessity has arisen for reduction of the actual drive force down to the set drive force, it is possible to perform operation so as to decrease said degree of engagement of the modulation clutch, so that the degree of engagement approaches the above described theoretical value. By performing this operation, the responsiveness of the control for diminishing the actual drive force is enhanced.

In a preferred embodiment of the present invention, said degree of engagement reduction unit may further comprise a rate adjustment unit (178) that, if the result of said operational state determination and the result of said drive force determination are both affirmative, changes the rate at which said degree of engagement is decreased (or the amount per unit time at which the degree of engagement decreases) according to the magnitude of said theoretical value, so that said degree of engagement approaches towards said theoretical value. By changing the rate of decrease of the degree of engagement according to the magnitude of the theoretical value, it is possible to reduce the actual drive force while ensuring that no sense of discomfort is imparted to the driver.

In a preferred embodiment of the present invention, if the result of said operational state determination and the result of said drive force determination are both affirmative (YES in S21), said degree of engagement reduction unit may reduce the degree of engagement at a predetermined high speed rate (S23) when said theoretical value is greater than a predetermined reference value (YES in S22), while reducing the degree of engagement at a rate that is lower than said high speed rate (S24 through S29) when that is not the case. For example, it is possible to make the high speed rate be a rate such that the degree of engagement is instantaneously reduced down to the theoretical value, while making the low speed rate which is lower than the high speed rate be a rate such that the degree of engagement is reduced down to the theoretical value over a predetermined time period (for example 0.1 seconds). Due to this, it is possible rapidly to reduce the actual drive force down to the set drive force, while ensuring that no sense of discomfort is imparted to the driver.

In a preferred embodiment of the present invention, if the result of said operational state determination and the result of said drive force determination are both affirmative (YES in S21), said degree of engagement reduction unit may reduce said degree of engagement to said theoretical value (S23) when said theoretical value is greater than a predetermined reference value (YES in S22).

In a preferred embodiment of the present invention, if the result of said operational state determination and the result of said drive force determination are both affirmative (YES in S21), said degree of engagement reduction unit may reduce said degree of engagement to a value that is closer to said theoretical value than a predetermined reference value (S26, S29) when said theoretical value is less than or equal to said reference value (NO in S22) and moreover said degree of engagement is greater than said reference value (YES in S25).

In a preferred embodiment of the present invention, when the result of said operational state determination and the result of said drive force determination are both affirmative (YES in S21), said degree of engagement reduction unit may reduce said degree of engagement (S27) on the basis of a build-down value that is determined according to the drive force deviation between said travel drive force and said set drive force, when both of said theoretical value and said degree of engagement are less than or equal to said reference value (NO in S22 and NO in S25). For example, if the result of the decision described above is that, if the degree of engagement is reduced by the build-down value corresponding to the drive force deviation, then the degree of engagement will decrease beyond the theoretical value (NO in the step S28), then it is possible to select control (S31) to reduce the degree of engagement by the above described build-down value.

In a preferred embodiment of the present invention, if the result of said operational state determination and the result of said drive force determination are both affirmative (YES in S21), and when both of said theoretical value and said degree of engagement are less than or equal to said reference value (NO in S22 and NO in S25), and moreover a value after build-down, that specifies said degree of engagement after said degree of engagement has been decreased on the basis of said build-down value, is greater than said theoretical value (YES in S28), said degree of engagement reduction unit may perform control to reduce said value after build-down to a value that is closer to said theoretical value than said value after build-down (S29). For example, if the result of the decision described above is that, even though the degree of engagement has been reduced by the build-down value corresponding to the drive force deviation, the degree of engagement does not decrease beyond the theoretical value (YES in the step S28), then it is possible to select control (S29) to reduce the degree of engagement towards the theoretical value.

In a preferred embodiment of the present invention: if the result of said operational state determination and the result of said drive force determination are both affirmative (YES in S21), when both of said theoretical value and said degree of engagement are less than or equal to said reference value (NO in S22 and NO in S25); a value after build-down, that specifies said degree of engagement after said degree of engagement has been decreased on the basis of said build-down value, is less than or equal to said theoretical value (NO in S28); and moreover said value after build-down is greater than or equal to a value that is a predetermined amount smaller than said theoretical value (YES in S30), said degree of engagement reduction unit may reduce said degree of engagement to said value after build-down (S32). For example, if the result of the decision described above is that, if the degree of engagement is reduced by the build-down value corresponding to the drive force deviation, the degree of engagement decreases beyond the theoretical value (NO in the step S28), then it is possible to select control (S31) to reduce the degree of engagement by the above described build-down value.

In a preferred embodiment of the present invention, said controller may further comprise a degree of engagement increase unit (176) that, if the result of said operational state determination is affirmative but the result of said drive force determination is negative (NO in S21), increases said degree of engagement (S33) on the basis of a build-up value at a lower speed than said build-down value. Due to this, if the actual drive force has dropped to lower than the set drive force, then it is possible to return the actual drive force to the set drive fore. In this case, since the build-up value is smaller than the build-down value, it is possible effectively to prevent overshoot in which the actual drive force exceeds the set drive force for a second time. Said build-up value is stored in the memory of the controller.

In a preferred embodiment of the present invention: said construction vehicle may be a wheel loader; said travel device may comprise a transmission; said task of a predetermined type may include excavation; and said controller may perform said operational state determination by making decisions as to whether or not the speed stage of said transmission is a predetermined forward speed stage, whether or not the tilt angle of said construction vehicle is less than a predetermined angle, whether or not said construction vehicle is moving forwards or is stopped, and whether or not, the state of said work equipment is a predetermined state during excavation. By making the decisions in this wheel loader on the basis of a plurality of conditions of these types, it is possible to detect with good accuracy an excavation task for which there may be a problem of the actual drive force exceeding the set drive force.

BRIEF DESCRIPTION OF THE DRAWINGS

FIG. 7 is a table showing an example of a relationship between drive force deviation and a build-down value; and FIG. 8 is a table showing an example of a relationship between drive force deviation and a build-up value.

EMBODIMENT FOR IMPLEMENTATION OF THE INVENTION

In the following, an embodiment of the present invention will be explained with reference to the drawings by citing a case of application thereof to a wheel loader, as an example of a construction vehicle. However, this embodiment could also be applied to a construction vehicle other than a wheel loader.

Figure 1:
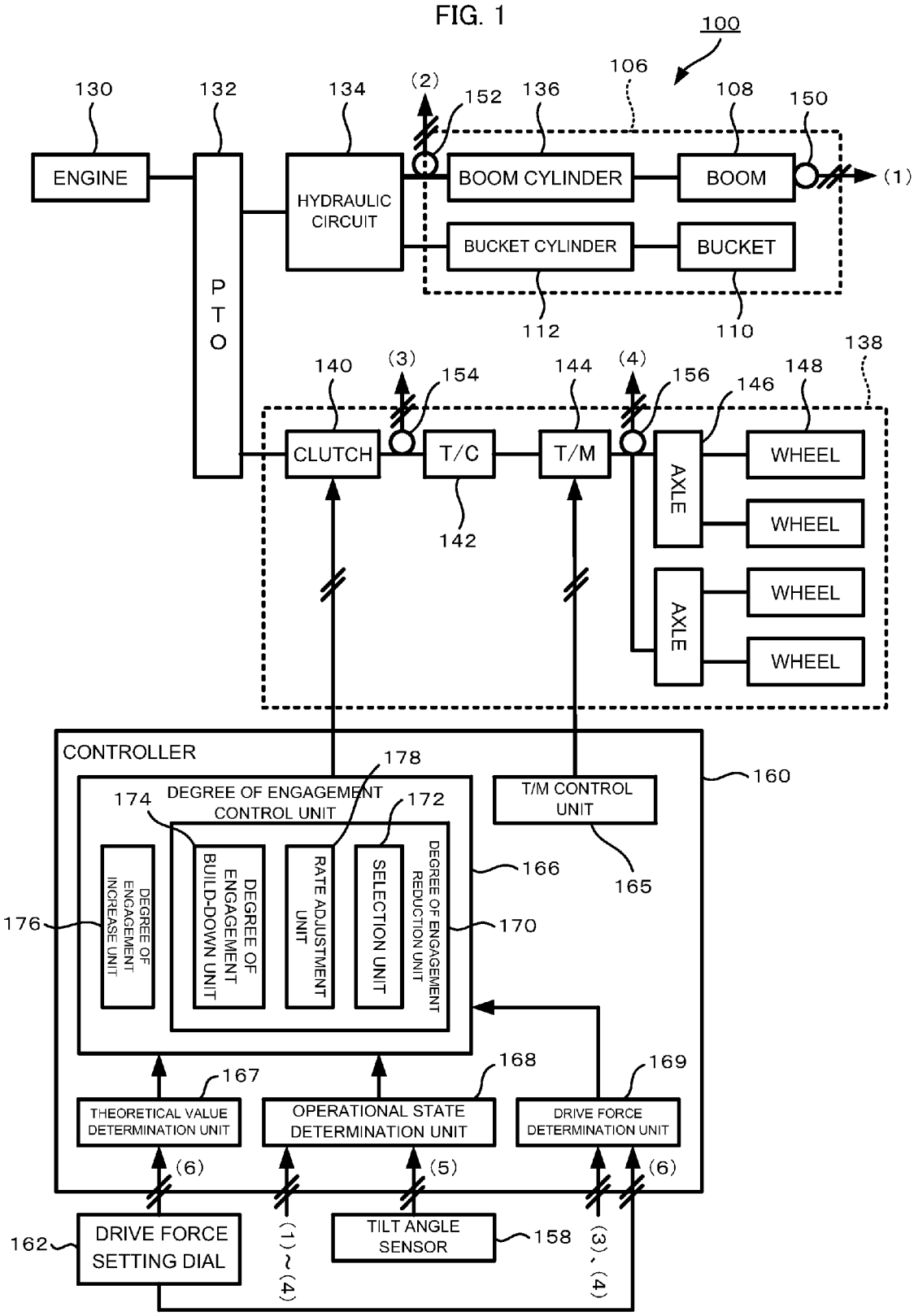
FIG. 1 is a block diagram schematically showing the overall structure of a wheel loader according to this embodiment.

FIG. 1 is a block diagram schematically showing the overall structure of a wheel loader 100 according to this embodiment.

Principally, this wheel loader 100 comprises an engine 130, a travel device 138, a work equipment 106, a hydraulic circuit 134, an output splitter (PTO: Power Take Off) 132 that divides the output of the engine 130 between the travel device 138 and the hydraulic circuit 134, and a controller 160.

The travel device 138 is a device for causing the wheel loader 100 to travel. This travel device 138, for example, comprises a clutch 140, a torque converter (T/C) 142, a transmission (T/M) 144, axles 146, and wheels 148. The power outputted from the engine 130 is transmitted to the wheels 148 via the clutch 140, the torque converter 142, the transmission 144, and the axles 146. The wheels 148 rotate on the basis of this power received from the engine 130, and thereby an output force (a travel drive force) 120 is outputted that attempts to make the wheel loader 100 move forwards or backwards (refer to FIG. 2). In the following, this travel drive force 120 will be simply termed the "travel drive force".

In this embodiment, the clutch 140 is not merely a clutch that is directly coupled (in which its amount of engagement is 100%) or disconnected (in which its amount of engagement is 0%); rather, a modulation clutch is employed, with which slippage is also allowed for. Thus, this clutch 140 is a clutch with which it is possible to adjust the degree of engagement to an intermediate value between 100% and 0%, and thereby to adjust the transmission ratio for the engine output. To put it in another manner, the more the engagement amount of the clutch 140 is decreased, the more the maximum value of engine torque that can be transmitted to the transmission 144 is decreased, and due to this the drive force 120 outputted from the wheels 148 comes to be decreased, even though the engine output is the same.

There are a number of possible methods for controlling the engagement amount of the clutch 140. In this embodiment, the method of controlling the degree of engagement with a clutch pressure will be explained. It should be understood that here, by a clutch pressure, is meant a control hydraulic pressure that is applied to the clutch 140. When the clutch pressure assumes a maximum (for example 25.0 [kgf/cm$^2$]), the degree of engagement becomes 100% (i.e. the clutch 140 is in the directly coupled state). And, as the clutch pressure becomes lower, the degree of engagement also decreases, and when the clutch pressure is at a minimum (for example 0.0 [kgf/cm$^2$]), the degree of engagement becomes 0% (i.e. the clutch 140 is in the disengaged state).

The work equipment 106 comprises a boom 108, a bucket 110, a boom cylinder 136, a bucket cylinder 112, and so on. The hydraulic circuit 134 is principally a circuit for driving the work equipment 106. This hydraulic circuit 134 supplies working hydraulic fluid to the boom cylinder 136 and the bucket cylinder 112 using a hydraulic pressure pump not shown in the figures that is driven by the engine 130, and drives each of the boom 108 and the bucket 110 by extending and retracting these cylinders 136 and 112 respectively.

Figure 2:
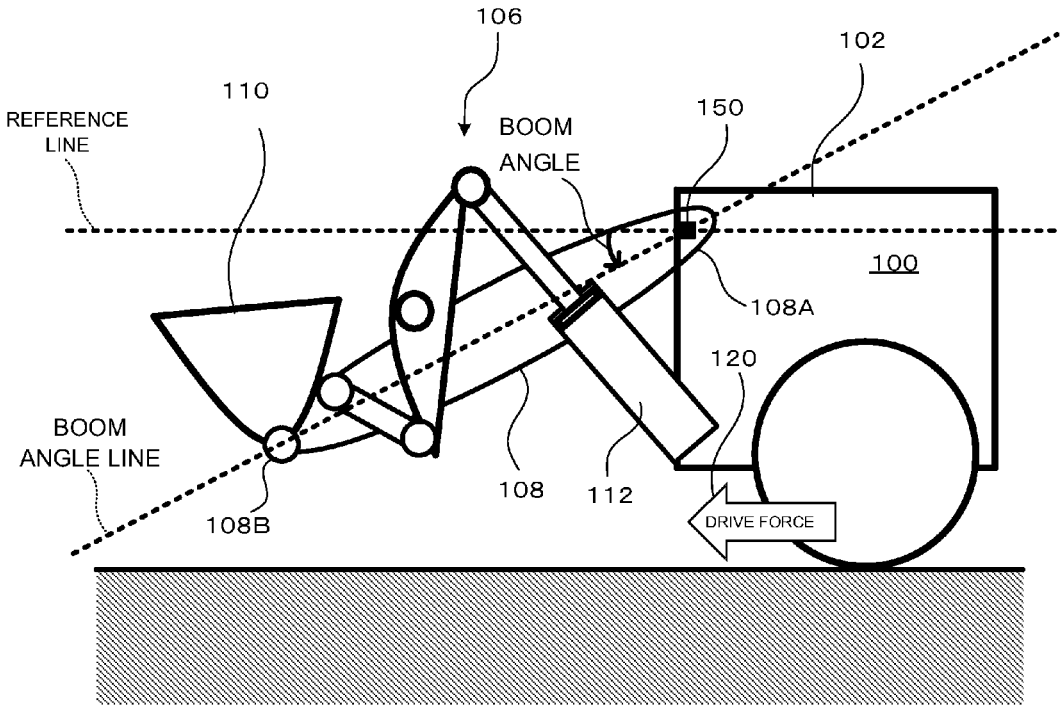
FIG. 2 is a side view of this wheel loader.

Now FIG. 2 will be referred to, FIG. 2 is a side view of the wheel loader 100. A linking point 108A is the point at which the boom 108 and the main body 102 of the wheel loader 100 are linked together. A boom angle sensor 150 is provided at this linking point 108A. This boom angle sensor 150 detects the angle subtended by the boom 108 with respect to the main body 102 (hereinafter termed the "boom angle"), and transmits the value that it has detected to the controller 160 as a signal that will be described hereinafter. In this embodiment, the boom angle is defined in the following manner. That is, considering a horizontal line through the linking point 108A, this is taken as being a reference line. Furthermore, considering a line that connects the linking point 108B between the boom 108 and the bucket 110 with the linking point 108A, this is taken as being the boom angle line. And the boom angle is defined as being the angle subtended by the reference line and the boom angle line. This boom angle has a positive value when the linking point 108B is higher than the reference line, and has a negative value when the linking point 108B is lower than the reference line.

Now we return to FIG. 1. A setting dial 162 for the driver to set an upper limit value for the drive force 120 is provided to this wheel loader 100. This setting dial 162 is, for example, used for the driver to set an upper limit value so that the drive force 120 should not become excessively great, as for example when a task such as excavation that requires a large drive force 120 is being performed. In the following, this upper limit, value for the drive force 120 that has been set with the setting dial 162 is termed the "set drive force value". When a set drive force value is set with the setting dial 162, signals that specify this set drive force value are outputted as shown by the arrow signs (6), and is inputted to the controller 160 (in concrete terms, to a theoretical value determination unit 167 and to a drive force determination unit 169). It should be understood that this set drive force value may not necessarily be set with a setting dial 162; it would also be acceptable for it to be set via a device of some other type than the setting dial 162. Moreover, it would also be acceptable to arrange for a degree of engagement control unit 166 that will be described hereinafter to set a set drive force value automatically.

Moreover, a plurality of sensors such as a boom bottom pressure sensor 152, a clutch output shaft rotational speed sensor 154, a T/M output shaft rotational speed sensor 156, a tilt angle sensor 158 and so on are provided to this wheel loader 100.

The boom bottom pressure sensor 152 detects the bottom pressure of the boom cylinder 136 (hereinafter termed the "boom bottom pressure"), and transmits the value that it has detected to the controller 160 (in concrete terms, to the operational state determination unit 168) as a signal shown by (2) in the figure.

The clutch output shaft rotational speed sensor 154 detects the rotational speed of the output shaft of the clutch 140, and transmits the value that it has detected to the controller 160 (in concrete terms, to the operational state determination unit 168 and to the drive force determination unit 169) as a signal shown by (3) in the figure.

The T/M output shaft rotational speed sensor 156 detects the rotational speed of the output shaft of the transmission 144, and transmits the value that it has detected to the controller 160 (in concrete terms, to the operational state determination unit 168 and to the drive force determination unit 169) as a signal shown by (4) in the figure.

The tilt angle sensor 158 detects the tilt angle around the fore and aft directional axis of the vehicle body (in other words, the pitch angle; hereafter this will be termed the "vehicle body tilt angle"), and transmits the value that it has detected to the controller 160 (in concrete terms, to the operational state determination unit 168) as a signal shown by (5) in the figure.

Furthermore, as previously described, the value of the boom angle as detected by the boom angle sensor 150 is also transmitted to the controller 160 (in concrete terms, to the operational state determination unit 168) as a signal shown by (1) in the figure.

The controller 160 is built as an electronic circuit that includes, for example, a computer that is provided with a microprocessor and memory. This controller 160 principally performs control of the clutch 140 and the transmission 144. This control is performed by the microprocessor of the controller 160 executing a predetermined program that is stored in the memory of the controller 160.

The controller 160 may, for example, include a T/M control unit 165, a degree of engagement control unit 166, a theoretical value determination unit 167, the operational state determination unit 168, and the drive force determination unit 169.

The T/M control unit 165 is a processing unit that controls the changing over of the speed stage of the transmission 144 by transmitting a signal commanding a speed stage to the transmission 144. While the transmission 144 may have speed stages of various types depending upon the type of vehicle, in this embodiment, it will be supposed that it has seven speed stages: forward first speed (F1), forward second speed (F2), forward third speed (F3), neutral (N), reverse first speed (R1), reverse second speed (R2), and reverse third speed (R3). The T/M control unit 165 is also able to store information specifying the current speed stage of the transmission 144 in the memory of the controller 160.

The theoretical value determination unit 167 is a processing unit that determines a theoretical value for the degree of engagement. This theoretical value for the degree of engagement is a value that the degree of engagement must assume in order to make the upper limit value of the drive force 120 be equal to the set drive force value. It should be understood that it would also be acceptable to arrange for this theoretical value to be calculated as a value of clutch pressure that corresponds to this degree of engagement (i.e. as a theoretical pressure value). In other words, this theoretical pressure value is the value of clutch pressure according to theory for making the upper limit value of the drive force 120 outputted from the wheels 148 be equal to the set drive force value.

Now an example of a method for calculation of the theoretical pressure value will be explained in the following.

First, the theoretical value determination unit 167 calculates the output shaft torque of the clutch 140 that is needed for a drive force 120 of the set drive force value to be outputted from the wheels 148 (hereinafter this will be termed the "target clutch output shaft torque"). In concrete terms, the theoretical value determination unit 167 calculates the output torque of the torque converter 142 (the T/C output torque) that is required for the set drive force value to be outputted from the wheels 148 using the following Equation 1. And the theoretical value determination unit 167 calculates the input torque for the torque converter 142 (the T/C input torque) using the following Equation 2. The T/C input torque calculated according to this Equation 2 is the target clutch output shaft torque.

(T/C output torque)−(set drive force value)/{(torque transmission efficiency)×(deceleration ratio of transmission 144)×(deceleration ratio of axle 146)/(effective radius of wheels 148)} (Equation 1)

(T/C input torque)=(T/C output torque)/(torque ratio) (Equation 2)

On the other hand, the output torque of the clutch 140 is calculated according to the following Equation 3. It should be understood that T is the torque of the output shaft of the clutch 140, η is a predetermined correction coefficient, (z/2) is the number of disks, P is the force pressing upon a piston that drives the clutch 140 (hereinafter simply termed the "piston"), do is the external diameter of the piston, and di is the internal diameter of the piston.

$$T=2\times\eta\times(z/2)\times\mu\times P\times(do-di)/4000 \quad \text{(Equation 3)}$$

Moreover, the force P that presses upon the piston is calculated according to the following Equation 4. It should be understood that p denotes the clutch pressure.

$$P=p\times\pi\times((do)2-(di)2)/400 \quad \text{(Equation 4)}$$

Accordingly, if the torque T of the output shaft of the clutch 140 is taken as being the target clutch output shaft torque (the value that was calculated by using Equation 1 and Equation 2), then the theoretical value determination unit 167 can calculate the value of p by using Equation 3 and Equation 4. This calculated value of p is the theoretical pressure value.

The drive force determination unit 169 is a processing unit that determines whether or not the value of the drive force 120 actually outputted by the travel device 138 (hereinafter termed the "actual drive force value") is larger than the set drive force.

In this case, it would also be acceptable for the actual drive value to be calculated by the drive force determination unit 169. In the following, a procedure for calculation of the actual drive force value will be explained in a simple manner.

First, the drive force determination unit 169 calculates the speed ratio between the input and output shafts of the torque converter 142 on the basis of the rotational speed of the output shaft of the clutch 140 as determined by the clutch output shaft rotational speed sensor 154 (which corresponds to the rotational speed of the input shaft of the torque converter 142) and the rotational speed of the output shaft of the transmission 144 as detected by the T/M output shaft rotational speed sensor 156 (The rotational speed of the input shaft of the transmission is obtained using the current deceleration ratio of the transmission at the transmission output shaft rotational speed. The rotational speed of the input shaft of the transmission corresponds to the rotational steed of the output shaft of the torque converter 142).

Next, the drive force determination unit 169 refers to a predetermined map in which are registered various speed ratios that can be obtained by the torque converter 142 and primary torque coefficients corresponding thereto, which are intrinsic coefficients of the torque converter 142, and acquires the primary torque coefficient that corresponds to the above described speed ratio that has been calculated. Next, the drive force determination unit 169 calculates the input torque of the torque converter 142 on the basis of the rotational speed of the output shaft of the clutch 140 (i.e. the rotational speed of the input shaft of the torque converter 142) detected as described above, and the primary torque coefficient that has been obtained as described above.

And the drive force determination unit 169 calculates the actual drive force value from the input torque to the torque converter 142 that has been calculated as described above, while taking into consideration the torque ratio (i.e. the efficiency of torque transmission), the deceleration ratio of the transmission 144, the deceleration ratio of the axles 146, and the effective radius of the wheels (tires) 148. Of course it would also be acceptable for the actual drive force value to be detected or to be calculated by some other method.

The operational state determination unit 168 is a processing unit that performs determination of the operational state and so on. This operational state determination unit 168, for example, may determine whether or not the work equipment 106 is performing a task of some predetermined type and moreover the travel device 138 is outputting drive force 120 in some predetermined travel direction. In this embodiment, for example, the task of a predetermined type may be supposed to be a high drive force task such as an excavation task. Here, such a high drive force task may be taken to be a task that requires a large drive force 120, and for which there is a possibility that the drive force 120 may undesirably become excessively great, in other words, a task for which there is a possibility that the actual drive force value may undesirably exceed the set drive force value. Furthermore in particular, since in an excavation task the bucket is pressed forward into natural earth by the forward drive force 120, accordingly the drive force for which there is a possibility of becoming excessively great during an excavation task is a forward drive force 120. Thus it may be arranged for the drive force 120 that is distinguished by the operational state determination unit and that is in the predetermined travel direction to be a forward drive force 120. Of course, this is not limited to being a forward drive force 120; it would also be acceptable to arrange for a backward drive force 120 to be taken as a subject. The operational state determination unit 168 makes the decision as to whether or not a high drive force task (i.e. an excavation task) is being performed, on the basis of the signals ((1) through (5) in FIG. 1) inputted from each of the sensors 150, 152, 154, 156, and 158 of various types. This decision by the operational state determination unit 168 will be described in detail hereinafter.

The degree of engagement control unit 166 is a processing unit that controls the degree of engagement by transmitting a signal that commands a clutch pressure (hereinafter termed the "clutch pressure command signal") to the clutch 140, thus adjusting the clutch pressure. In the following, h value of the clutch pressure than has thus been adjusted by the degree of engagement control unit 166 will be termed the "output pressure value". The degree of engagement control unit 166 controls the degree of engagement to a value that corresponds to the output pressure value by making the clutch pressure become equal to the output pressure value.

The degree of engagement control unit 166 may, for example, comprise a degree of engagement reduction unit 170 and a degree of engagement increase unit 176. Moreover, the degree of engagement reduction unit 1780 may, for example, comprise a selection unit 172, a degree of engagement build-down unit 174, and a rate adjustment unit 178. For example, the degree of engagement reduction unit 170 is a processing unit that decreases the degree of engagement towards the theoretical value if the result of the determination performed by the operational state determination unit 168 and the result of the determination performed by the drive force determination unit 169 are both affirmative. The processing performed by these various units 170, 172, 174, 176, and 178 will be explained in detail hereinafter with reference to the flow chart of FIG. 4.

If the result of the decision performed by the operational state determination unit 168 as to whether or not the work equipment 106 is performing a high drive force task and moreover the travel device 138 is outputting drive force 120 in the predetermined travel direction is affirmative, then the degree of engagement control unit 166 performs dial drive force control, so as to make the upper limit value of the drive force 120 become equal to the set drive force value. By doing this, it becomes possible to perform dial drive force control when there is a possibility that the drive force 120 may undesirably become excessively great.

In the following, this dial drive force control will be explained in concrete terms.

Figure 3:
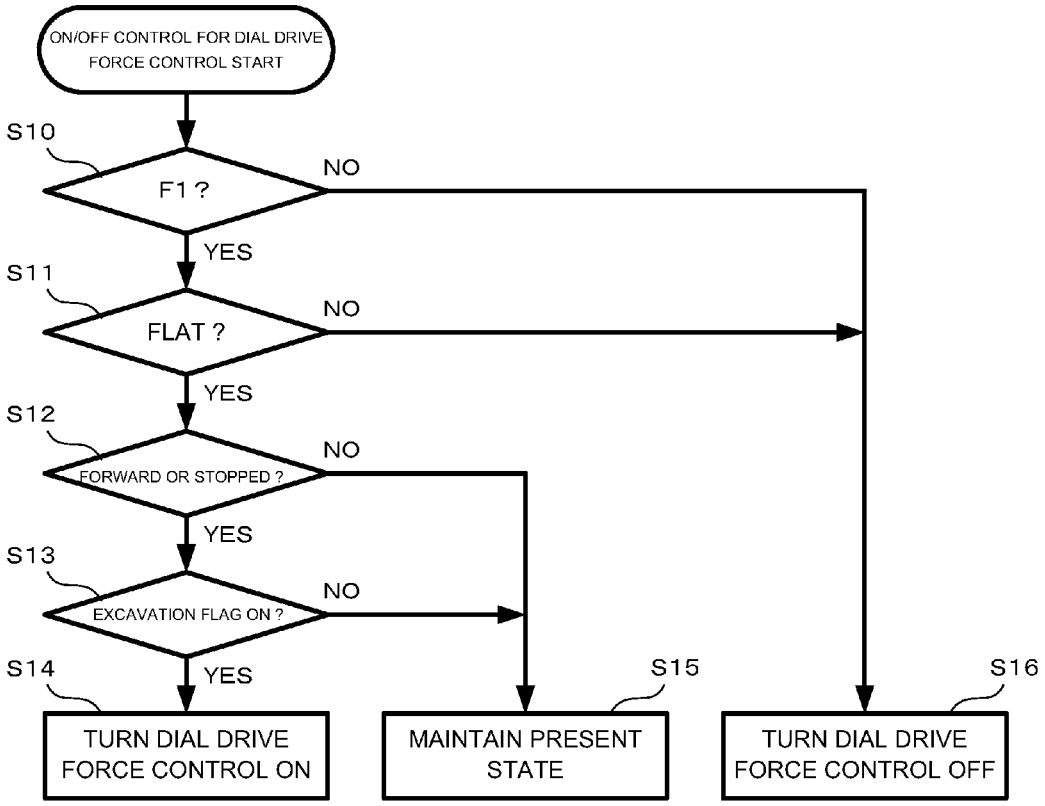
FIG. 3 is a flowchart for processing to control the starting or stopping (ON/OFF) of dial drive for control.

FIG. 3 is a flow chart of processing to control the starting or stopping (ON/OFF) of dial drive force control. In the following flow chart, as an advance decision as to whether or not to perform dial drive force control or whether or not to stop dial drive force control, in concrete terms, a decision is made as to whether or not an excavation task is being performed. This control procedure is, for example, executed repeatedly at predetermined time intervals (for example at intervals of several tens of milliseconds to several seconds) when a set drive force value is set with the setting dial 162.

First, the operational state determination unit 168 makes a decision as to whether or not the current speed stage of the transmission 144 is F1 (the first forward speed stage) (a step S10). For example, the operational state determination unit 168 may make a decision as to whether or not the current speed stage is the first forward speed stage (F1) by referring to information specifying the speed stage of the transmission 144 that is stored in the memory of the controller 160. Moreover, as a variant example, it would also be acceptable to arrange for the operational state determination unit 168 to make a decision as to whether or not the current speed stage is the first forward speed stage (F1) on the basis of some other signal, such as for example a speed stage selection signal from a shift actuation device (typically, a gear lever) at the driver's seat, or by detecting the actual gearing state of the transmission 144.

If the current speed stage of the transmission 144 is not F1 (NO in the step S10), then the degree of engagement control unit 166 turns dial drive force control OFF (a step S16). In other words, the speed stage in which it is possible to output a large forward drive force 120 is F1, and generally the speed stage that is selected when an excavation task is to be performed is F1. Accordingly, if the speed stage is not F1, then the possibility is high that an excavation task is not being performed. And accordingly, if the speed stage is not F1, then it is ensured that the degree of engagement control unit 166 does not perform dial drive force control.

On the other hand, if the current speed stage of the transmission 144 is F1 (YES in the step S10), then the operational state determination unit 168 makes a decision as to whether or not the vehicle body is upon a flat road (a step S11) in concrete terms, the operational state determination unit 168 makes a decision as to whether or not the vehicle body is upon a flat road, for example as described below. That is, the first operational state determination unit 168 calculates the vehicle speed on the basis of the rotational speed of the output shaft of the transmission 144 as received from the T/M output shaft rotational speed sensor 156, and calculates the acceleration on the basis of the calculated vehicle speed. Next, the operational state determination unit 168 corrects error of the vehicle body tilt angle that has been measured by the tilt angle sensor 158 (i.e. error due to the acceleration), while taking into account the acceleration that has thus been calculated. And the operational state determination unit 168 makes a decision as to whether or not the vehicle body tilt angle after amendment is within a predetermined flat road angular width (for example the range from −2 to 2°, with the horizontal taken as 0°), and moreover this state of being within the flat road angular width has continued for at least a predetermined flat road continued decision interval (for example 2 seconds). If the vehicle body tilt angle after amendment is within the flat road angular width, and moreover this state of being within the flat road angular width has continued for at least the predetermined flat road continued decision interval, then the operational state determination unit 168 is able to decide that the vehicle body is upon a flat road.

If the vehicle body is not upon a flat road (NO in the step S11), then the degree of engagement control unit 166 turns dial drive force control OFF (the step S16). This is because it is also considered that, if the vehicle body is not upon a flat road, a task of a type for which a large drive force is required (i.e. an excavation task) is no being performed. Accordingly, in this case as well, the degree of engagement control unit 166 ensures that dial drive force control is not performed.

On the other hand, if the vehicle body is upon a flat road (YES in the step S11), then the degree of engagement control unit 166 makes a decision as to whether or not the direction of progression of the wheel loader 100 (hereinafter simply termed the "progression direction") is forward or stopped (a step S12). In concrete terms, the operational state determination unit 168 is able to decide upon the current progression direction by, for example, storing in the memory a status (hereinafter termed the "progression direction status") that indicates the current progression direction (one of forward, backward, or stopped), and by referring to this progression direction status. For example, if the current progression direction is forward, then the value of the progression direction status is set to "forward status"; if the current progression direction is backward, then it is set to "backward status"; and if the current progression direction is stopped, then it is set to "stopped status".

For example, the operational state determination unit 168 may detect that a predetermined progression direction change condition has been met, and may change the value of the progression direction status at the timing that this has been detected. Here, the progression direction change condition is the condition for the operational state determination unit 168 to recognize that the progression direction has changed. In his progression direction change condition, there are included a stopped condition for recognizing a change to stopped status, a forward condition for recognizing a change to forward status, and a backward condition for recognizing a chance to backward status. If the operational state determination unit 168 has detected that the stopped condition has been met, then it changes the value of the progression direction status to the stopped status; if it has detected that the forward condition has been met, then it changes the value of the progression direction status to the forward status; and if it has detected that the backward condition has been met, then it changes the value of the progression direction status to the backward status. In the following, examples of these progression direction change conditions (i.e. of the stopped condition, of the forward condition, and of the backward condition) will be given.

The Stopped Condition

This is that the state in which the rotational speed of the output shaft of the transmission 144 as detected by the T/M output shaft rotational speed sensor 156 is less than a progression direction decision value (for example 109 [rpm]) has continued for at least a predetermined first progression direction continuation decision interval (for example 0.01 seconds), or that the controller 160 has just been started.

The Forward Condition

This is that the state in which the rotational speed of the output shaft of the transmission 144 as detected by the T/M output shaft rotational speed sensor 156 is greater than or equal to the progression direction decision value (for example 109 [rpm]) has continued for at least a predetermined second progression direction continuation decision interval (for example 0.05 seconds); moreover that the current speed stage of the transmission 144 is a forward speed stage (in this embodiment, F1, F2, or F3); and also that the value of the current progression direction status is not the backward status.

The Backward Condition

This that the state in which the rotational speed of the output shaft of the transmission 144 as detected by the T/M output shaft rotational speed sensor 156 is greater than or equal to the progression direction decision value (for example 109 [rpm]) has continued for at least the predetermined second progression direction continuation decision interval (for example 0.05 seconds); moreover that the current speed stage of the transmission 144 is a backward speed stage (in this embodiment, R1, R2, or R3); and also that the value of the current progression direction status is not the forward status.

It should be understood that, in the stopped condition, the fact that the rotational speed of the output shaft of the transmission 144 is less than 109 [rpm] means that the running speed of the wheel loader 100 is less than about 1 [km/h]. Accordingly, if the progression direction decision value is taken as being 109 [rpm] and the progression direction continuation decision interval is taken as being 0.01 seconds, then, when the state that the running speed is less than about 1 [km/h] continues for 0.01 seconds or more, the value of the progression direction status is changed to the stopped status by the operational state determination unit 168 that has detected this fact.

Moreover, with regard to the current speed stage of the transmission 144 in the forward condition and the backward condition, in a similar manner to the step S10, the operational state determination unit 168 is able to know which speed stage the transmission is in by referring to information stored in the memory of the controller 160 that specifies the speed stage of the transmission 144.

If the progression direction status is not the forward status or the stopped status (NO in the step S12) (in other words, if it is the backward status), then the degree of engagement control unit 166 maintains the present state of dial drive control without alteration (a step S15). In other word, if currently the dial drive force control is in the ON state, then the degree of engagement control unit 166 keeps dial drive force control ON without alteration, while if it is in the OFF state then it keeps dial drive force control OFF without alteration.

On the other hand, if the progression direction status is the forward status or the stopped status (YES in the step S12), then the operational state determination unit 168 makes a decision as to whether or not the wheel loader 100 is actually in the state of performing an excavation task (hereinafter this will be termed "in the excavating state") (a step S13). In concrete terms, for example, the operational state determination unit 168 may make a decision as to whether or not the wheel loader 100 is in the excavating state by storing in the memory information (hereinafter termed the "excavation flag") specifying whether or not the wheel loader 100 is in the excavating state, and by referring to this excavation flag. In this embodiment, the value of the excavation flag is set to ON when the wheel loader 100 is in the excavating state and is set to OFF when the wheel loader 100 is not in the excavating state.

For example, the operational state determination unit 168 may detect that a predetermined excavation flag ON condition is met or that a predetermined excavation flag OFF condition is met, and may change the value of the excavation flag from OFT to ON, or from ON to OFF, at the timing of this detection. Here, the excavation flag ON condition is the condition used by the operational state determination unit 168 to recognize that the wheel loader 100 is in the excavating state. If the operational state determination unit 168 has detected that this excavation flag ON condition is met, then it changes the value of the excavation flag from OFF to ON. On the other hand, the excavation flag OFF condition is the condition used by the operational state determination unit 168 to recognize that the wheel loader 100 is not in the excavating state. If the operational state determination unit 168 has detected that this excavation flag OFF condition is met, then it changes the value of the excavation flag from ON to OFF. In the following, examples of the excavation flag ON condition and of the excavation flag OFF condition will be given.

The Excavation Flag ON Condition

This is that the value of a boom bottom pressure decrease flag (to be described hereinafter) is ON, and moreover that the boom bottom pressure as detected by the boom bottom pressure sensor 152 is greater than or equal to a predetermined boom elevation decision threshold value (for example 12.75 [MPa]), The Excavation Flag OFF Condition This is that the value of the boom bottom pressure decrease flag is ON, that the current speed stage of the transmission 144 is neutral (N) or a backward speed stage (in this embodiment, R1, R2, or R3), or that the boom angle as detected by the boom angle sensor 150 is greater than a predetermined angle threshold value (for example −10°).

Here, this boom bottom pressure decrease flag is information that specifies whether or not the wheel loader 100 is in a state in which the boom 108 is elevated (in other words, is in a state in which unloading is being performed). The boom bottom pressure decrease flag is also stored in the memory of the controller 160, in a similar manner to the excavation flag. In this embodiment, the value of the boom bottom pressure decrease flag is set to OFF when the wheel loader 100 is in its state with the boom 108 elevated, while its value is set to OFF when the wheel loader 100 is in its state with the boom 108 not elevated (in other words, its state in which the boom 108 is lowered or the not working state). Changing over of the value of the boom bottom pressure decrease flag (from ON to OFF or from OFF to ON) may, for example, be performed as follows. That is, the operational determination unit 166 may change the value of the boom bottom pressure decrease flap from OFF to ON when it has been detected that the state in which the boom bottom pressure as detected by the boom bottom pressure sensor 152 is smaller than the boom elevation decision threshold value (for example 12.75 [MPa]) has continued for at least a predetermined boom bottom pressure decrease continuation interval (for example 1 second). Moreover, the operational state determination unit 168 may change the value of the boom bottom pressure decrease flag from ON to OFF when the value of the excavation flag has changed to ON.

It should be understood that, for the excavation flap OFF condition, for the current speed stage of the transmission 141, in a similar manner to the step S10, the operational state determination unit 168 may know which is the current speed stage by referring to information stored in the memory of the controller 160 that specifies the speed stage of the transmission 144.

If it has been decided that the wheel loader 100 is not in the excavating state (in other words, if the value of the excavation flag was OFF) (NO in the step S130, then the degree of engagement control unit 166 maintains the dial drive force control just as it is in the present state (the step S15). In other words, if the present state of dial drive force control is ON, then the degree of engagement control unit 166 keeps it at ON without alteration, whereas if the present state thereof is OFF, the degree of engagement control unit 166 keeps it at OFF without alteration.

On the other hand, if it has been decided that the wheel loader 100 is in the excavating state (in other words, if the value of the excavation flag was ON) (YES in the step S13), then the degree of engagement control unit 166 turns dial drive force control to ON (a step S14).

The above is the flow chart for the processing that controls the starting or stopping (ON/OFF) of dial drive force control. As shown in this flow chart, in this embodiment, a decision is made in advance (in the steps S10 through S13) as to whether or not an excavation task is being performed, and if as the result it is decided that an excavation task is being performed, then the dial drive force control is started.

Figure 4:
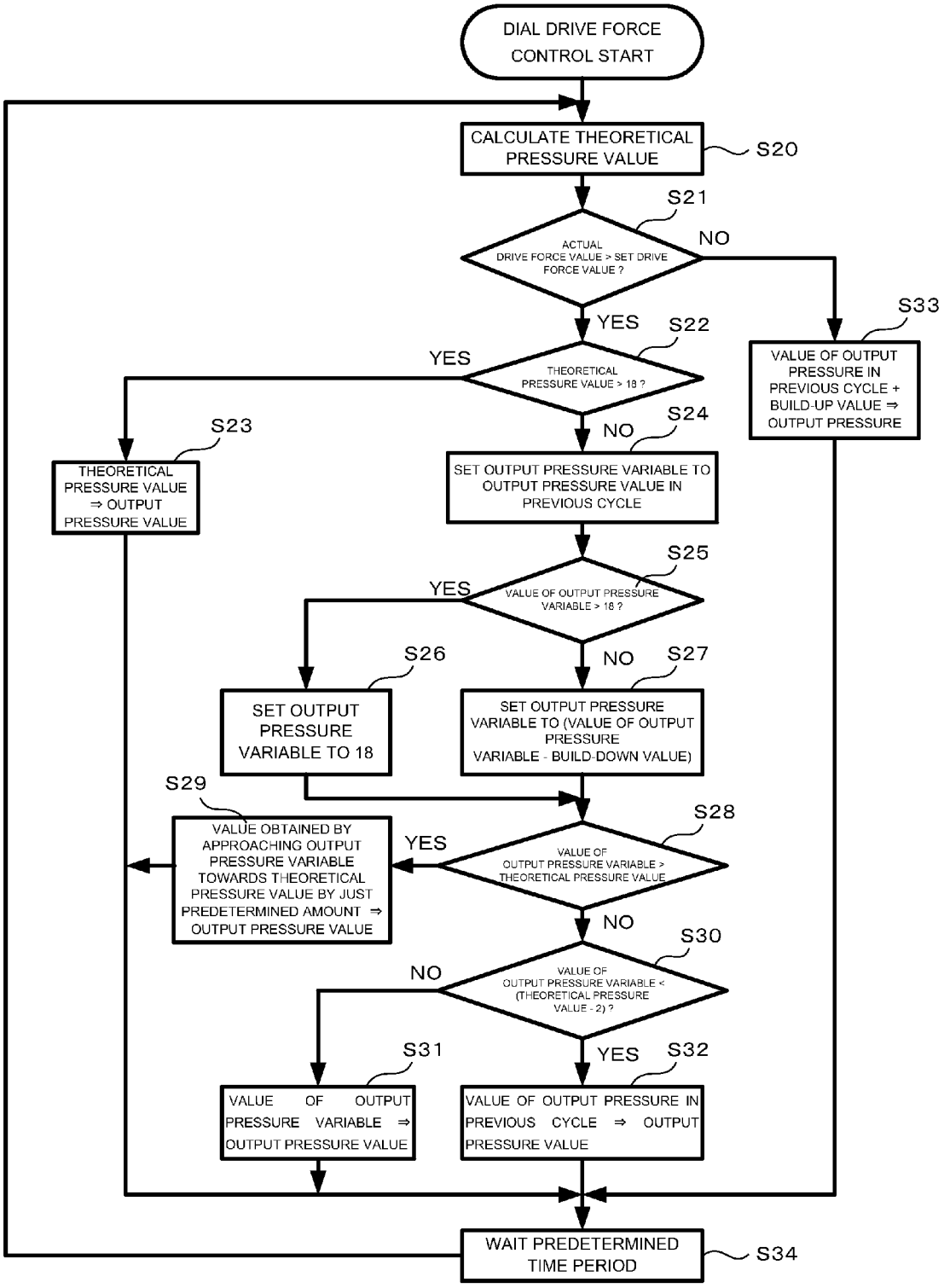
FIG. 4 is a flow chart showing the details of dial drive force control.

FIG. 4 is a flow chart showing the details of the dial drive force control.

The processing of the steps S20 through S33 shown in FIG. 4 is executed repeatedly at predetermined time intervals (for example at time intervals of 10 milliseconds). In other words, the steps S20 through S33 are one cycle of processing, and the drive force 120 is controlled to the set drive force value by executing this one cycle of processing repeatedly. Moreover, in this embodiment, the maximum value of the clutch pressure is 25 [kg/cm$^2$]. Accordingly, if the clutch pressure is at this maximum of 25 [kg/cm$^2$], the clutch 140 is in the directly coupled state (i.e. its degree of engagement is 100%).

Principally, dial drive control is control to bring down the actual drive force value to some desired value if the actual drive force value is greater than the set drive force value, and, for example, includes high speed reduction control, medium high speed reduction control, and fine reduction control. Moreover, it would also be acceptable for the dial drive force control to include control (for example, fine increase control) to bring up the actual drive force value to some desired value if the actual drive force value is less than or equal to the set drive force value. In the following, high speed reduction control, medium high speed reduction control, fine reduction control, and fine increase control will be explained in that order.

High Speed Reduction Control

First, the high speed reduction control will be explained.

This high speed reduction control is control for, with the result of determination by the operational state determination unit 168 and the result of determination by the drive force determination unit 169 both being affirmative, reducing the engagement at a predetermined high speed rate when the theoretical value is greater than a predetermined reference value.

The theoretical value determination unit 167 calculates a theoretical pressure value on the basis of the set drive force value (a step S20).

The drive force determination unit 169 makes a decision as to whether or not the result of determination by the drive force determination unit 169 is affirmative, in other words as to whether or not the actual drive force value is greater than the set drive force value (a step S21).

If the actual drive force value is greater than the set drive force value (YES in the step S21), then the rate adjustment unit 178 makes a decision as to whether or not the theoretical pressure value that was calculated in the step S20 is greater than a predetermined clutch pressure decrease reference value (a step S22). Here, the clutch pressure decrease reference value is a reference value that, when decreasing the clutch pressure, is referred to in order to determine how the clutch pressure is to be decreased. This clutch pressure decrease reference value, for example, may be 18 [kgf/cm$^2$] which corresponds to a degree of engagement of about 75%, and, according to the type of vehicle which is the object of control, is set to a value that matches that type of vehicle. In this embodiment, it will be supposed that this clutch pressure reference value is 18 [kgf/cm$^2$].

If the theoretical pressure value is larger than the clutch pressure decrease reference value (18 [kgf/cm$^2$]) (YES in the step S220, then, in order to reduce the speed of engagement at a predetermined high speed rate, the rate adjustment unit 178 takes the theoretical pressure value that has been calculated in the step S20 as the output value pressure value, and transmits a clutch pressure command signal to the clutch 140 that commands this output pressure value (a step S23).

Due to this, the clutch pressure is controlled so as to become equal to the output pressure value (i.e. the theoretical pressure value) immediately, and the degree of engagement of the clutch 140 becomes a degree of engagement that corresponds to the output pressure value (i.e. to the theoretical pressure value). In this high speed seduction control, the rate adjustment unit 178 immediately reduces the clutch pressure to the theoretical pressure value which is larger than the clutch pressure decrease reference value, and control is exerted so as to approach the actual drive force value to the set drive force value right away at a high rate of speed. Due to this high speed reduction control, the actual drive force decreases extremely rapidly. And since the clutch pressure decrease reference value corresponds to a quite high degree of engagement (for example around 75 percent), accordingly even if the clutch pressure is decreased to the theoretical value which is larger than the decrease reference value, still there is no fear that this high speed reduction control will oppose any particular obstacle to the task being performed by the vehicle, or cause any great sense of discomfort to the driver.

Medium High Speed Reduction Control

Next, the medium high speed reduction control will be explained.

This medium high speed reduction control is control for, with the result of determination by the operational state determination unit 168 and the result of determination by the drive force determination unit 169 both being affirmative, reducing the degree of engagement to a value closer to the theoretical value than the predetermined reference value when the theoretical value is less than or equal to the predetermined reference value, and when moreover the degree of engagement is greater than the reference value.

With the result of determination by the operational state determination unit 168 and the result of determination by the drive force determination unit 169 both being affirmative, when the theoretical value and the degree of engagement are both less than or equal to the reference value, and when moreover a value after build-down that specifies the degree of engagement that has been reduced on the basis of a build-down value is greater than the theoretical value, it would also be acceptable to arrange for this medium high speed reduction control to be control for reducing the degree of engagement to a value closer to the theoretical value than the value after build-down.

If, after the theoretical pressure value has been calculated in the step S20, a decision is reached in the step S21 that the actual drive force value is larger than the set drive force value (YES in the step S21), then the rate adjustment unit 178 makes a decision as to whether or not the theoretical pressure value calculated in the step S20 is greater than the predetermined clutch pressure decrease reference value (18 [kgf/cm$^2$]) (a step S22).

If the theoretical pressure value is less than or equal to the clutch pressure decrease reference value (18 [kgf/cm$^2$]) (NO in the step S22), then the rate adjustment unit 178 sets the output pressure variable to the output pressure value in the previous cycle (a step S24). Here, the output pressure value in the previous cycle is the output pressure value that was outputted to the clutch 140 in the previous cycle of processing.

Next, the rate adjustment unit 178 makes a decision as to whether or not the value of the output pressure variable that was set in the step S24 is greater than the clutch pressure decrease reference value (18 [kgf/cm$^2$]) (a step S25).

If the value of the output pressure variable is greater than the clutch pressure decrease reference value (18 [kgf/cm$^2$]) (YES in the step S25), then the rate adjustment unit 178 sets the output pressure variable to the clutch pressure decrease reference value (18 [kgf/cm$^2$]) (a step S26). In other words, the value of the output pressure variable is immediately changed from the output pressure value in the previous cycle to the clutch pressure decrease reference value (18 [kgf/cm$^2$]).

On the other hand, if the value of the output pressure variable is less than or equal to the clutch pressure decrease reference value (18 [kgf/cm$^2$]) (NC) in the step S25), then the rate adjustment unit 178 sets the output pressure variable to a value (the value after build-down) based upon a build-down value that is determined according to the drive force deviation between the actual drive force value and the set drive force value (a step S27). Here, the value after build-down is a value obtained by subtracting the build-down value from the output pressure variable (i.e. from the output pressure value in the previous cycle).

Furthermore, here, the build-down value is the value of the width amount by which the clutch pressure is decreased per one cycle. A value that is proportional to the drive force deviation may be used for this build-down value for example, a value that is obtained by dividing the drive force deviation by a predetermined value (for example, 500) may be employed. One example of a relationship between the drive force deviation and the build-down value in this embodiment is shown in FIG. 7. In FIG. 7, the build down value is the pressure reduction per each 10 msec. Moreover, even if the drive force deviation increases to be greater than or equal to 3000 kgf, the build-down value does not increase over 0.03 [kg/cm$^2$].

In a step S28, the selection unit 172 makes a decision as to whether or not the value of the output pressure variable (in other words, the clutch pressure reference value that was set in the step S26 (18 [kgf/cm$^2$]) or the value after build-down that was set in the step S27) is greater than the theoretical pressure value (a step S28).

In the step S28, when, in the case that the step S26 has been passed through (i.e. in the case that the output pressure value in the previous cycle is greater than the clutch pressure decrease reference value), the clutch pressure decrease reference value, or, in the alternative case that the step S27 has been passed through (i.e. in the case that the output pressure value in the previous cycle is less than or equal to the clutch pressure decrease reference value), the value after build-down, has been made the respective output pressure value, the selection unit 172 makes a decision as to whether or not this output pressure value has become greater than the theoretical pressure value or alternatively whether it has become less than or equal to the theoretical pressure value. It should be understood that, if the step S26 is passed through, a decision result of NO is reached in the step S28 when the theoretical pressure value is the same value as the clutch pressure decrease reference value (in other words, 18 [kgf/cm$^2$]).

If the result of the decision in the step S28 is that the value of the output pressure variable is greater than the theoretical pressure value, in other words if, when the output pressure value is set to the clutch pressure decrease reference value (18 [kgf/cm$^2$]) or the value after build-down, this output pressure value will become greater than the theoretical pressure value, (YES in the step S28), then the rate adjustment unit 178 corrects the value of the output pressure variable (in other words, the clutch pressure decrease reference value or the value after build-down) to a value that is approached to the theoretical pressure by just a predetermined amount, and takes this output pressure variable value after amendment as the output pressure value (a step S29).

In concrete terms, the rate adjustment unit 178 takes, as the output pressure value, a value that is obtained by subtracting a value (hereinafter termed the "correction width amount"), obtained by multiplying the differential between the output pressure variable value and the theoretical pressure value by a predetermined correction ratio less than 1 and greater than 0, from the output pressure variable value (in other words, a value obtained by approaching the output pressure variable value towards the theoretical pressure value by lust the correction width amount). And the rate adjustment unit 178 transmits a clutch pressure command signal that commands this output pressure value to the clutch 140 (a step S29). The medium high speed reduction control is performed in this manner. In other words, the clutch pressure is controlled to a value that is approached to the theoretical pressure value by just the above described correction width amount, and the degree of engagement of the clutch 140 becomes a degree of engagement that corresponds to this clutch pressure.

When this medium high speed reduction control is repeatedly performed over a predetermined plurality of cycles (for example, over 10 cycles if the correction ratio is 0.1, in other words over 0.1 seconds, if the period of one cycle is 10 milliseconds), the clutch pressure comes to decrease to approach the theoretical pressure value. To put it in another manner, this medium high speed reduction control is control to decrease the clutch pressure towards the theoretical pressure value at a "medium high speed rate" that is slightly lower than the high speed rate during the high speed reduction control described above. Due to this, the actual drive force value is approached to the set drive force value at the medium high speed rate. This medium high speed reduction control is applicable to cases in which the theoretical pressure value of the clutch pressure is lower than the clutch pressure decrease reference value (for example the degree of engagement corresponds to around 75%), and, in actual cases, this is most employed in the initial stage of drive force reduction control (a "first region" of FIG. 6 that will be described hereinafter is the time interval in which this control is performed), and thereby it is ensured that operation is effectively performed to decrease the actual drive force rapidly). Since, in this medium high speed reduction control, the rate of decrease of the clutch pressure is slightly lower than during high speed reduction control, accordingly there is no fear that this control will oppose any particular obstacle to the task being performed by the vehicle, or will cause any great sense of discomfort to the driver.

Fine Reduction Control

Next, the fine reduction control will be explained.

This fine reduction control is control for, with the result of determination by the operational state determination unit 168 and the result of determination by the drive force determination unit 169 both being affirmative, reducing the degree of engagement to the value after build-down when the theoretical value and the degree of engagement are both less than or equal to the reference value, and when moreover said value after build-down that specifies said degree of engagement that has been reduced on the basis of the build-down value is greater than said theoretical value, the value after build-down is less than or equal to the theoretical value, and moreover the build-down value is greater than or equal to the theoretical value by a value of a predetermined level of smallness.

In this fine reduction control, the processing from the step S20 to the step S26 or S27 is the same as in the case of the medium, high speed reduction control. Due to this, only the processing of the steps S28 and subsequently will, be explained.

In the step S28, the selection unit 172 makes a decision as to whether or not the value of the output pressure variable (in other words, the clutch pressure decrease reference value (18 [kgf/cm$^2$]) that was set in the step S26 or the value after build-down that was set in the step S27) is greater than the theoretical pressure value (the step S28).

When the result of the decision in the step S28 is that the value of the output pressure variable (in other words the clutch pressure decrease reference value (18 [kgf/cm$^2$]) or, when the value after build-down has been taken as the output pressure value, that output pressure value) is less than or equal to the theoretical pressure value (NO in the step S28), then the degree of engagement build-down unit 174 makes a decision as to whether or not the value of the output pressure variable (in other words, the clutch pressure decrease reference value or the value after build-down) is smaller than an offset subtracted value that is obtained by subtracting lust a predetermined offset value (for example 2 [kgf/cm$^2$]) from the theoretical pressure value (a step S30).

If the value of the output pressure variable is smaller than the offset subtracted value (YES in the step S30), then the degree of engagement build-down unit 174 takes the output pressure value in the previous cycle as being the output pressure value for this cycle (a step S32).

This is considered to be the clutch pressure becoming too low, for some reason. In other words, the degree of engagement build-down unit 174 mitigates abrupt behavior by maintaining the clutch pressure at the output pressure value, just as it was in the previous cycle.

On the other hand, if the value of the output pressure variable is greater than or equal to the offset subtracted value (NO in the step S30), then the degree of engagement build-down unit 174 takes the value of the output pressure variable (in other words the clutch pressure decrease reference value (18 [kgf/cm$^2$]) or the value after build-down) as being the output pressure value, and transmits a clutch pressure command signal that commands this output pressure value to the clutch 140 (a step S31). In this manner, the degree of engagement build-down unit 174 performs fine reduction control so as to make the value after build-down, which is a value which is lower than the output pressure value in the previous cycle by just the build-down value, be the output pressure value this time. Due to this, the clutch pressure is controlled to the output pressure value (i.e. the clutch pressure decrease reference value or the value after build-down), and the degree of engagement of the clutch 140 becomes a degree of engagement that corresponds to the output pressure value (i.e. the clutch pressure decrease reference value or the value after build-down).

When this fine reduction control is performed repeatedly over a plurality of cycles, the degree of engagement build-down unit 174 exercises control so as to decrease the clutch pressure by the build-down value. As described above, the build-down value is a value that is determined according to the drive force deviation (the difference between the actual drive force value and the set drive force value) (for example, a value that is proportional to the drive force deviation).

As shown in FIG. 7, the smaller is the drive force deviation, the smaller does the build-down value become. Accordingly, when the fine reduction control is performed repeatedly over a plurality of cycles, an actual drive force value that is larger than the set drive force value is reduced at a rate that corresponds to the difference between that actual drive force value and the set drive force value, so as to approach the set drive force value. It should be understood that in this fine reduction control, as a result, sometimes it happens that the clutch pressure becomes lower than the theoretical pressure value. However, since the actual drive force value is larger than the set drive force value when this control is performed (since a YES decision result is obtained in the step S21), accordingly it is desirable to reduce the clutch pressure with a fixed limit. Thus, in this embodiment, within a fixed range (i.e. within the range from the offset subtracted value to the theoretical pressure value), even if the clutch pressure becomes lower than the theoretical pressure value, the degree of engagement build-down unit 174 performs control by reducing it, so that the actual drive force value approaches towards the set drive force value. According to this fine reduction control, it is possible to control the actual drive force so that it becomes equal to the set drive force with good accuracy, while suppressing control undershoot.

Fine Increase Control

Next, the fine increase control will be explained.

This fine increase control is control for, with the result of determination by the operational state determination unit 168 being affirmative but the result of determination by the drive force determination unit 169 not being affirmative, increasing the degree of engagement on the basis of a build-up value of lower speed than the build-down value.

The theoretical, pressure value is calculated in the step S20, and if, in the decision of the step S21, the result is that the actual drive force value is less than or equal to the set drive force value (NO in the step S21), then the degree of engagement increase unit 176 takes, as the output pressure value, a value that is obtained by adding a build-up value that is determined according to the drive force deviation to the value of the output pressure variable (i.e. to the output pressure value in the previous cycle), and transmits a clutch pressure command signal that commands this output pressure value (i.e. the value after build-up) to the clutch 140 (a step S33). It should be understood that, for the value after build-up, a value is taken that is greater than the output pressure value in the previous cycle by just the build-up value.

Here, the relationship between the drive force deviation and the build-up value is shown in FIG. 8. The build-up value is the width over which the clutch pressure is raised per one cycle, and is a value that is proportional to the drive force deviation; for example, it may be a value that is obtained by dividing the drive force deviation by a predetermined value (for example, 1000). In FIG. 8, the build-up value is the pressure increase over 10 msec. Moreover, even if the drive force deviation has increased to be greater than 3000 kgf, the build-up value is not increased beyond 0.03 [kgf/cm$^2$] it should be understood that while, in FIGS. 7 and 8, the build-up value and the build-down value have the same value, it will be acceptable for the build-up value to be a value that is smaller than the build-down value.

Due to the processing of the step S33 described above, the clutch pressure is controlled to the value after build-up, and the degree of engagement of the clutch 140 becomes a degree of engagement that corresponds to the value after build-up.

In this fine increase control, the degree of engagement increase unit 176 takes the value after build-up, which is a value higher than the output pressure value in the previous cycle by just the build-up width amount, as the output pressure value for this cycle. In other words, when this fine increase control is performed repeatedly over a plurality of cycles, the degree of engagement increase unit 176 comes to perform control so as to increase the clutch pressure by the build-up value. Here, if the build-up value is set to be smaller than the build-down value, then an actual drive force value that is smaller than the set drive force value is increased, and is approached towards the set drive force value, at a more gentle rate than the decrease rate when it was greater than the set drive force value. After the drive force 120 has been lowered by the above described reduction control (the high speed reduction control, the medium high speed reduction control, and the fine reduction control) to the vicinity of the set drive force value, if the drive force 120 drops too much, then this fine increase control is executed in order to correct it, and in order to maintain the actual drive force value at a value in the neighborhood of the set drive force value. According to this fine increase control, it is possible to control the actual drive force so that it becomes equal to the set drive force with good accuracy, while suppressing control overshoot.

After the step S23, S29, S31, S32, or S33, the degree of engagement control unit 166 performs the processing of the step S201 again, after having waited for a predetermined time period (for example 10 milliseconds). In other words, the processing of the steps S20 through S33 is repeated at predetermined time intervals.

Figure 5:
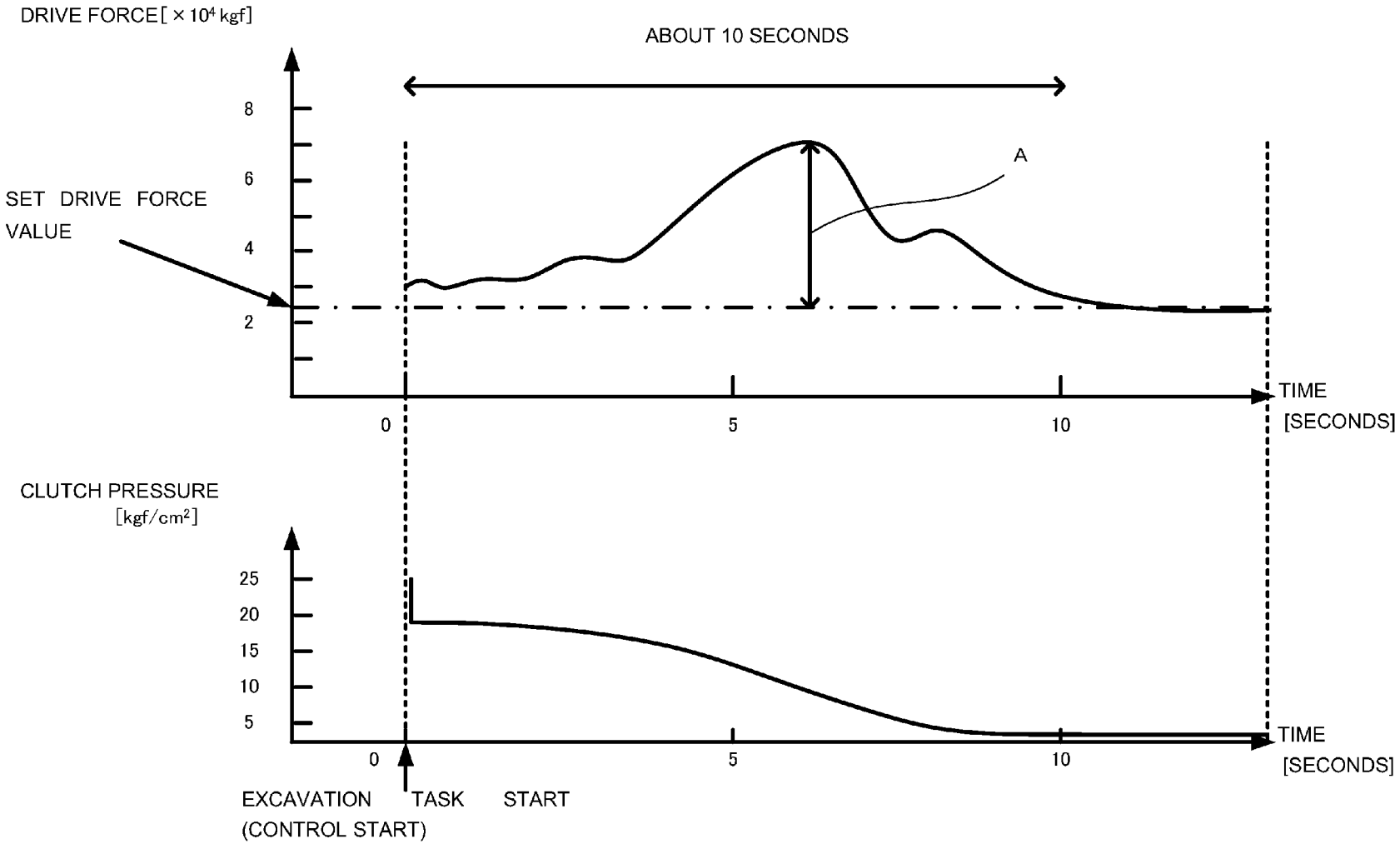
FIG. 5 is a figure showing values of the changes over time of drive force and clutch pressure during an excavation task that were actually measured when prior art dial drive force control was experimentally performed.

FIG. 5 is a figure showing the values of the change over time of the drive force 120 and the clutch pressure during an excavation task that were actually measured when prior art dial drive force control was experimentally performed. The upper portion of this figure shows the change over time of the drive force 120, while the lower portion thereof shows the change over time of the clutch pressure. Here, this prior art dial drive force control is control in which, from the start of control until the actual drive force value reaches the set drive force value, the clutch pressure is decreased with the same decrease value as during the fine reduction control according to this embodiment (i.e. with the build-down value, which is determined according to the drive force deviation), it should be understood that the value of the set drive force is 23000 [kgf].

In this case, according to prior art dial drive force control, the clutch pressure did not drop rapidly, as shown in the change over time figure for clutch pressure (the lower part of FIG. 5). In concrete terms, even after 5 seconds had elapsed from the start of the excavation task (i.e. from the start of control), the clutch pressure still had a value higher than 10 [kgf/cm$^2$].

As a result, as shown in the figure for the change over time of the drive force 120 (the upper part of FIG. 5), it took a long time for the drive force 120 to drop down to the set drive force value. For example, it took around 10 seconds until for the drive force to stabilize in the vicinity of the set drive force value. Since, as described above, the time period required for an excavation task is not normally as long as that (for example, it may be of the order of 5 seconds), accordingly hardly any beneficial effect is obtained from this prior art dial drive force control. Moreover, since the clutch pressure did not drop very quickly, accordingly, after the dial drive force control had started, the actual drive force increased to a value (shown by the arrow A) that greatly exceeded the set drive force. It should be understood that while, under this prior art control, it is also possible to set the build-down value for the clutch pressure higher in order to reduce the clutch pressure at high speed, if it is arranged to do this, then here is a danger of the occurrence of large undershoot (i.e. of the drive force 120 dropping far below the set drive force value). As a result, there is a fear that hunting of the drive force may occur.

Figure 6:
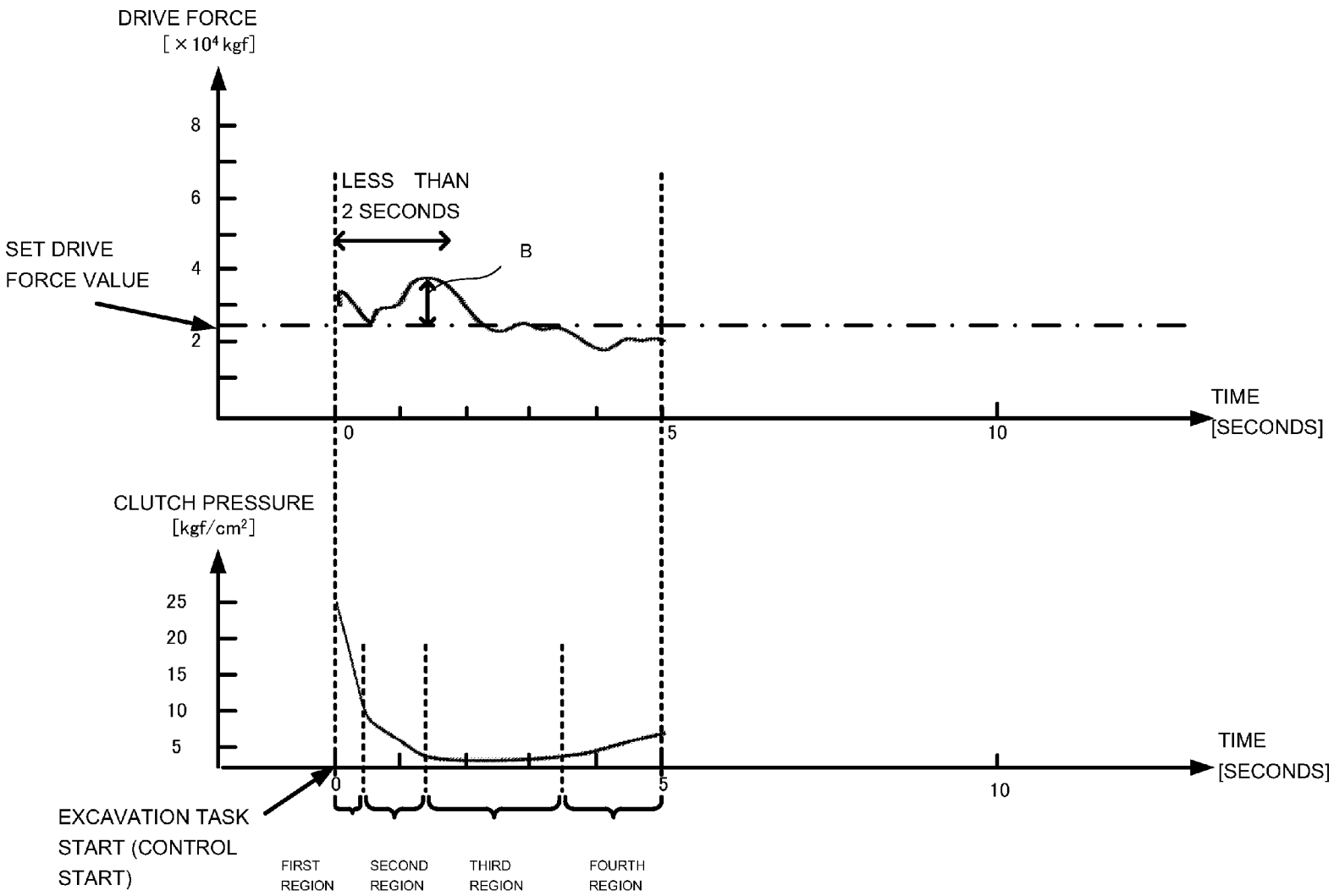
FIG. 6 is a figure showing values of the changes over time of drive force and clutch pressure during an excavation task that were actually measured when dial drive force control according to this embodiment was experimentally performed.

And FIG. 6 is a figure showing values of the changes over time of the drive force 120 and the clutch pressure during an excavation task that were actually measured when dial drive force control according to this embodiment was experimentally performed. The upper portion of this figure shows the change over time of the drive force 120, while the lower portion thereof shows the change over time of the clutch pressure. In a similar manner to the case with FIG. 5, the value of the set drive force is 23000 [kgf].

With the dial drive control according to this embodiment, the clutch pressure dropped rapidly, as shown in the change over time figure for clutch pressure (the lower portion of FIG. 6). To speak in concrete terms, it only took about 0.5 seconds from the start of working (i.e. from the start of control) for the clutch pressure to drop to 10 [kgf/cm$^2$], and moreover it only took about 1.5 seconds from the start of working (i.e. from the start of control) for the clutch pressure to drop to 5 [kgf/cm$^2$].

As a result, as shown in the figure for change over time of the drive force 120 (the upper cart of FIG. 6), the drive force 120 converged to the vicinity of the set drive force value in less than about 2 seconds. Moreover, since the clutch pressure was lowered rapidly, when the amount by which the actual drive force exceeded the set drive force after the start of control (shown by the arrow B) is compared with the case of prior art control shown in FIG. 5 (shown by the arrow A), it is seen to have been extremely small. In addition, undershoot hardly occurred at all.

It should be understood that, when considering the figure for the change over time of the clutch pressure (the lower part of FIG. 6), it is considered that it is possible to divide this curve of the change over time into four regions like those shown in FIG. 6, due to differences in the pattern of the curve. And it is considered that the clutch pressure is being reduced according to the medium high speed reduction control in the first region and according to the fine reduction control in the second region. Moreover, in the third region, it is considered that control by the step S32 in FIG. 4 is being performed, in other words that the clutch pressure is being maintained just as it is at the output value in the previous cycle; and, in the fourth region, it is considered that the clutch pressure is being raised according to the fine increase control.

As has been explained above, by the dial drive force control according to this embodiment being performed, there is almost no occurrence of undershoot, and it becomes possible to reduce the drive force 120 down to the set drive force value straight away with good responsiveness.

The embodiment of the present invention described above is only an example given for explanation of the present invention, and the scope of the present invention is not to be considered as only being limited to that embodiment. Provided that the is of the present invention is adhered to, it may also be implemented in various other ways.

Explanation of the Reference Symbols

100: wheel loader, 102: main body, 106: work equipment, 108: boom, 110: bucket, 112: bucket cylinder, 130: engine, 132: PTO, 134: hydraulic circuit, 136: boom cylinder, 138: travel device, 140: clutch, 142: torque converter, 144: transmission, 146: axle, 148: wheel, 150: boom angle sensor, 152: boom bottom pressure sensor, 154: clutch output shaft rotational speed sensor, 156: T/M output shaft rotational speed sensor, 158: tilt angle sensor, 160: controller, 162: drive force setting dial, 165: T/M control unit, 166: degree of engagement control unit, 167: theoretical value determination unit, 168: operational state determination unit, 169: drive force determination unit, 170: degree of engagement reduction unit, 172: selection unit, 174: degree of engagement build-down unit, 176: degree of engagement increase unit, 178: rate adjustment unit.

The invention claimed is:

1. A construction vehicle, comprising:

a power source;

a travel device that comprises a modulation clutch connected to said power source, and that receives power from said power source via said modulation clutch and outputs travel drive force;

a work equipment for performing excavation and at least one other type of task;

a drive force setting device that sets a set drive force; and a controller that controls the degree of engagement of said modulation clutch, on the basis of said travel drive force outputted from said travel device and said set drive force set by said drive force setting device;

wherein said controller comprises:

a theoretical value determination unit that determines a theoretical value, which is a value that said degree of engagement must assume in order to make the upper limit value of said travel drive force be equal to said set drive force;

an operational state determination unit that performs operational state determination by determining whether or not said work equipment is performing a task of a predetermined type and moreover said travel device is outputting said travel drive force in a predetermined travel direction;

a drive force determination unit that performs drive force determination by determining whether or not said travel drive force is greater than said set drive force; and a degree of engagement reduction unit that, when the result of said operational state determination and the result of said drive force determination are both affirmative, reduces said degree of engagement so that said degree of engagement approaches towards said theoretical value, wherein when the result of said operational state determination and the result of said drive force determination are both affirmative, said degree of engagement reduction unit changes the rate at which said degree of engagement is decreased according to the magnitude of said theoretical value, so that said degree of engagement approaches towards said theoretical value, and when the result of said operational state determination and the result of said drive force determination are both affirmative, said degree of engagement reduction unit reduces the degree of engagement at a predetermined high speed rate when said theoretical value is greater than a predetermined reference value, while reducing the degree of engagement at a rate that is lower than said high speed rate when that is not the case.

2. A construction vehicle according to claim 1, wherein, when the result of said operational state determination and the result of said drive force determination are both affirmative, said degree of engagement reduction unit reduces said degree of engagement to said theoretical value when said theoretical value is greater than a predetermined reference value.

3. A construction vehicle according to claim 1, wherein, when the result of said operational state determination and the result of said drive force determination are both affirmative, said degree of engagement reduction unit reduces said degree of engagement to a value that is closer to said theoretical value than a predetermined reference value when said theoretical value is less than or equal to said reference value and moreover said degree of engagement is greater than said reference value.

4. A construction vehicle according to claim 2, wherein, when the result of said operational state determination and the result of said drive force determination are both affirmative, said degree of engagement reduction unit reduces said degree of engagement on the basis of a build-down value that is determined according to the drive force deviation between said travel drive force and said set drive force, when both of said theoretical value and said degree of engagement are less than or equal to said reference value.

5. A construction vehicle according to claim 4, wherein, when the result of said operational state determination and the result of said drive force determination are both affirmative, and when both of said theoretical value and said degree of engagement are less than or equal to said reference value, and moreover a value after build-down, that specifies said degree of engagement after said degree of engagement has been decreased on the basis of said build-down value, is greater than said theoretical value, said degree of engagement reduction unit reduces said value after build-down to a value that is closer to said theoretical value than said value after build-down.

6. A construction vehicle according to claim 4, wherein:

when the result of said operational state determination and the result of said drive force determination are both affirmative, when both of said theoretical value and said degree of engagement are less than or equal to said reference value; a value after build-down, that specifies said degree of engagement after said degree of engagement has been decreased on the basis of said build-down value, is less than or equal to said theoretical value; and moreover said value after build-down is greater than or equal to a value that is a predetermined amount smaller than said theoretical value, said degree of engagement reduction unit decreases said degree of engagement to said value after build-down.

7. A construction vehicle according to claim 4, wherein said controller further comprises a degree of engagement increase unit that, when the result of said operational state determination is affirmative but the result of said drive force determination is negative, increases said degree of engagement on the basis of a build-up value at a lower speed than said build-down value.

8. A construction vehicle according to claim 1, wherein:

said construction vehicle is a wheel loader;

said travel device comprises a transmission;

said task of a predetermined type includes excavation; and said controller performs said operational state determination by making decisions as to whether or not the speed stage of said transmission is a predetermined forward speed stage, whether or not the tilt angle of said construction vehicle is less than a predetermined angle, whether or not said construction vehicle is moving forwards or is stopped, and whether or not the state of said work equipment is a predetermined state during excavation.

9. A control device that controls the degree of engagement of a modulation clutch connected to a power source on the basis of a travel drive force outputted from a travel device that comprises said modulation clutch, and that receives power from said power source via said modulation clutch and outputs said travel drive force, and a set drive force provided by a drive force setting device that sets said set drive force, comprising:

a theoretical value determination means that determines a theoretical value, which is a value that said degree of engagement must assume in order to make the upper limit value of said travel drive force be equal to said set drive force;

an operational state determination means that performs operational state determination by determining whether or not a work equipment for performing excavation and at least one other type of task is performing a task of a predetermined type and moreover said travel device is outputting said travel drive force in a predetermined travel direction;

a drive force determination means that performs drive force determination by determining whether or not said travel drive force is greater than said set drive force; and a degree of engagement reduction means that, when the result of said operational state determination and the result of said drive force determination are both affirmative, reduces said degree of engagement so that said degree of engagement approaches towards said theoretical value, wherein when the result of said operational state determination and the result of said drive force determination are both affirmative, said degree of engagement reduction unit changes the rate at which said degree of engagement is decreased according to the magnitude of said theoretical value, so that said degree of engagement approaches towards said theoretical value, and when the result of said operational state determination and the result of said drive force determination are both affirmative, said degree of engagement reduction unit reduces the degree of engagement at a predetermined high speed rate when said theoretical value is greater than a predetermined reference value, while reducing the degree of engagement at a rate that is lower than said high speed rate when that is not the case.

10. A control method, implemented by a controller comprising a microprocessor and a memory, for controlling the degree of engagement of a modulation clutch connected to a power source on the basis of a travel drive force outputted from a travel device that comprises said modulation clutch, and that receives power from said power source via said modulation clutch and outputs said travel drive force, and a set drive force provided by a drive force setting device that sets said set drive force, wherein:

an operational state determination is performed by the controller by determining whether or not a work equipment for performing excavation and at least one other type of task is performing a task of a predetermined type and moreover said travel device is outputting said travel drive force in a predetermined travel direction;

a drive force determination is performed by the controller by determining whether or not said travel drive force is greater than said set drive force;

when the result of said operational state determination and the result of said drive force determination are both affirmative, a theoretical value is determined by the controller, the theoretical value being a value that said degree of engagement must assume in order to make the upper limit value of said travel drive force be equal to said set drive force;

said degree of engagement is reduced by the controller so that said degree of engagement approaches towards said theoretical value;

when the result of said operational state determination and the result of said drive force determination are both affirmative, a rate at which said degree of engagement is decreased according to the magnitude of said theoretical value is changed by the controller so that said degree of engagement approaches towards said theoretical value; and when the result of said operational state determination and the result of said drive force determination are both affirmative, the degree of engagement at a predetermined high speed rate is reduced by the controller when said theoretical value is greater than a predetermined reference value, and the degree of engagement is reduced by the controller at a rate that is lower than said predetermined high speed rate when that is not the case.

11. A construction vehicle according to claim 3, wherein, when the result of said operational state determination and the result of said drive force determination are both affirmative, said degree of engagement reduction unit reduces said degree of engagement on the basis of a build-down value that is determined according to the drive force deviation between said travel drive force and said set drive force, when both of said theoretical value and said degree of engagement are less than or equal to said reference value.

12. A construction vehicle according to claim 1, wherein:

said construction vehicle is a wheel loader;

said travel device comprises a transmission;

said task of a predetermined type includes excavation; and said controller performs said operational state determination by making decisions as to whether or not the speed stage of said transmission is a predetermined forward speed stage, whether or not the tilt angle of said construction vehicle is less than a predetermined angle, whether or not said construction vehicle is moving forwards or is stopped, and whether or not the state of said work equipment is a predetermined state during excavation.

13. A construction vehicle according to claim 2, wherein:

said construction vehicle is a wheel loader;

said travel device comprises a transmission;

said task of a predetermined type includes excavation; and said controller performs said operational state determination by making decisions as to whether or not the speed stage of said transmission is a predetermined forward speed stage, whether or not the tilt angle of said construction vehicle is less than a predetermined angle, whether or not said construction vehicle is moving forwards or is stopped, and whether or not the state of said work equipment is a predetermined state during excavation.

14. A construction vehicle according to claim 3, wherein:

said construction vehicle is a wheel loader;

said travel device comprises a transmission;

said task of a predetermined type includes excavation; and said controller performs said operational state determination by making decisions as to whether or not the speed stage of said transmission is a predetermined forward speed stage, whether or not the tilt angle of said construction vehicle is less than a predetermined angle, whether or not said construction vehicle is moving forwards or is stopped, and whether or not the state of said work equipment is a predetermined state during excavation.

15. A construction vehicle according to claim 4, wherein:

said construction vehicle is a wheel loader;

said travel device comprises a transmission;

said task of a predetermined type includes excavation; and said controller performs said operational state determination by making decisions as to whether or not the speed stage of said transmission is a predetermined forward speed stage, whether or not the tilt angle of said construction vehicle is less than a predetermined angle, whether or not said construction vehicle is moving forwards or is stopped, and whether or not the state of said work equipment is a predetermined state during excavation.

16. A construction vehicle according to claim 5, wherein:

said construction vehicle is a wheel loader;

said travel device comprises a transmission;

said task of a predetermined type includes excavation; and said controller performs said operational state determination by making decisions as to whether or not the speed stage of said transmission is a predetermined forward speed stage, whether or not the tilt angle of said construction vehicle is less than a predetermined angle, whether or not said construction vehicle is moving forwards or is stopped, and whether or not the state of said work equipment is a predetermined state during excavation.

17. A construction vehicle according to claim 6, wherein:

said construction vehicle is a wheel loader;

said travel device comprises a transmission;

said task of a predetermined type includes excavation; and said controller performs said operational state determination by making decisions as to whether or not the speed stage of said transmission is a predetermined forward speed stage, whether or not the tilt angle of said construction vehicle is less than a predetermined angle, whether or not said construction vehicle is moving forwards or is stopped, and whether or not the state of said work equipment is a predetermined state during excavation.

* * * * *